US009441585B2

(12) United States Patent
Lim et al.

(10) Patent No.: US 9,441,585 B2
(45) Date of Patent: Sep. 13, 2016

(54) APPARATUS FOR FIXING RESERVOIR BODY ASSEMBLY OF FUEL PUMP MODULE INTO FUEL TANK

(71) Applicant: COAVIS, Sejong-si (KR)

(72) Inventors: Jong Keun Lim, Cheongju-si (KR); Joon Sup Kim, Daejeon (KR); Chan Heum Yoon, Yeongi-gun (KR); Tae Hoon Lee, Sejong-si (KR); Yong Hwan Choi, Daejeon (KR)

(73) Assignee: COAVIS (KR)

( * ) Notice: Subject to any disclaimer, the term of this patent is extended or adjusted under 35 U.S.C. 154(b) by 184 days.

(21) Appl. No.: 14/450,483

(22) Filed: Aug. 4, 2014

(65) Prior Publication Data

US 2015/0075654 A1 Mar. 19, 2015

(30) Foreign Application Priority Data

Sep. 16, 2013 (KR) ..... 10-2013-0111273

(51) Int. Cl.

| | |
|---|---|
| ***F02M 37/10*** | (2006.01) |
| ***F02M 37/00*** | (2006.01) |
| *F02M 37/22* | (2006.01) |

(52) U.S. Cl.

CPC ..... *F02M 37/103* (2013.01); *F02M 37/0052* (2013.01); *F02M 37/10* (2013.01); *F02M 37/106* (2013.01); *F02M 2037/225* (2013.01); *Y10T 137/86035* (2015.04)

(58) Field of Classification Search

CPC .. F02M 37/103; F02M 37/10; F02M 37/106; F02M 37/0052; F02M 2037/225

USPC ..... 123/509, 495; 137/565.17

See application file for complete search history.

(56) References Cited

FOREIGN PATENT DOCUMENTS

| | | |
|---|---|---|
| JP | 64013257 | 1/1989 |
| JP | 64013258 | 1/1989 |
| JP | 02169855 | 6/1990 |
| KR | 1999003283 | 1/1999 |

*Primary Examiner* — Mahmoud Gimie

(74) *Attorney, Agent, or Firm* — Cantor Colburn LLP

(57) ABSTRACT

Provided is an apparatus for fixing a reservoir body assembly of a fuel pump module into a fuel tank. The apparatus includes: a fixed retainer fixed into the fuel tank to be integrated with the fuel tank; and a moving coupled retainer coupled with the fixed retainer in a state in which a reservoir body assembly pumping fuel in the fuel tank is disposed at an assembling location with the fixed retainer to mount the reservoir body assembly so as to fix the reservoir body assembly.

3 Claims, 5 Drawing Sheets

APPARATUS FOR FIXING RESERVOIR BODY ASSEMBLY OF FUEL PUMP MODULE INTO FUEL TANK

CROSS-REFERENCE TO RELATED APPLICATIONS

This application claims priority under 35 U.S.C. §119 to Korean Patent Application No. 10-2013-0111273, filed on Sep. 16, 2013, in the Korean Intellectual Property Office, the disclosure of which is incorporated herein by reference in its entirety.

TECHNICAL FIELD

The following disclosure relates to an apparatus for fixing a fuel pump module.

BACKGROUND

A vehicle is provided with a fuel tank in which fuel is stored.

In addition, the vehicle is provided with a fuel pump module for forcibly supplying the fuel filled in the fuel tank to an engine.

Generally, as illustrated in FIG. 1, the fuel pump module is configured to include a reservoir body assembly 1, a flange assembly 2, a guide rod 3 connecting the flange assembly 2 to the reservoir body assembly 1, a spring 4 disposed at an outer side of the guide rod 3, and a fuel pump 5 for a forced flowing of fuel.

This structure may be confirmed in Korean Utility Model Application No. 20-1997-0016877 (Korean Utility Model Registration No. 20-0160774), or the like.

In most cases, the flange assembly is fixed to an inlet part of the fuel tank and the reservoir body assembly is disposed at a bottom of the tank.

In addition, the guide rod which connects the flange assembly to the reservoir body assembly while guiding a movement of the spring is configured to slidably move to an inner side of the reservoir body assembly.

Further, the spring is disposed on the outer side of the guide rod and is disposed between the flange assembly and the reservoir body assembly to allow the reservoir body assembly to be disposed at the bottom of the fuel tank at all times.

However, the foregoing fuel pump is hardly mounted in the fuel tank having a low height.

To solve the above problem, a form in which the flange assembly and the reservoir body assembly are not disposed on a straight line but the reservoir body assembly is diagonally inclined, and the like has been proposed.

The method may slightly more conveniently mount the fuel pump in the fuel tank, but when a size of the fuel tank is smaller, the method may be hardly to apply.

RELATED ART DOCUMENT

Patent Document (Patent Document 1) Korean Utility Model Application No. 20-1997-0016877

SUMMARY

An embodiment of the present invention is directed to providing an apparatus for easily fixing a reservoir body assembly included in a fuel pump module having a structure without a guide rod connecting a reservoir body assembly to a flange assembly into a fuel tank so as to be mounted in a fuel tank having a very low height.

Another embodiment of the present invention is directed to providing an ease separation of a reservoir body assembly.

In one general aspect, a fixed retainer may be disposed in a fuel tank in an integrated state and a moving coupled retainer and a fixed retainer may be coupled with each other, having a reservoir body assembly disposed therebetween, in the state in which the reservoir body assembly is disposed at a location at which the fixed retainer is mounted to fix the reservoir body assembly, thereby easily fixing the reservoir body assembly into the fuel tank having the low height.

The apparatus may have the fixed retainer fixed into the fuel tank to be integrated with the fuel tank.

Further, the apparatus may have a moving coupled retainer coupled with the fixed retainer in a state in which a reservoir body assembly is disposed at a mounting location with the fixed retainer to mount the reservoir body assembly pumping fuel in the fuel tank so as to fix the reservoir body assembly.

Other features and aspects will be apparent from the following detailed description, the drawings, and the claims.

DETAILED DESCRIPTION OF MAIN ELEMENTS

Figure 1:
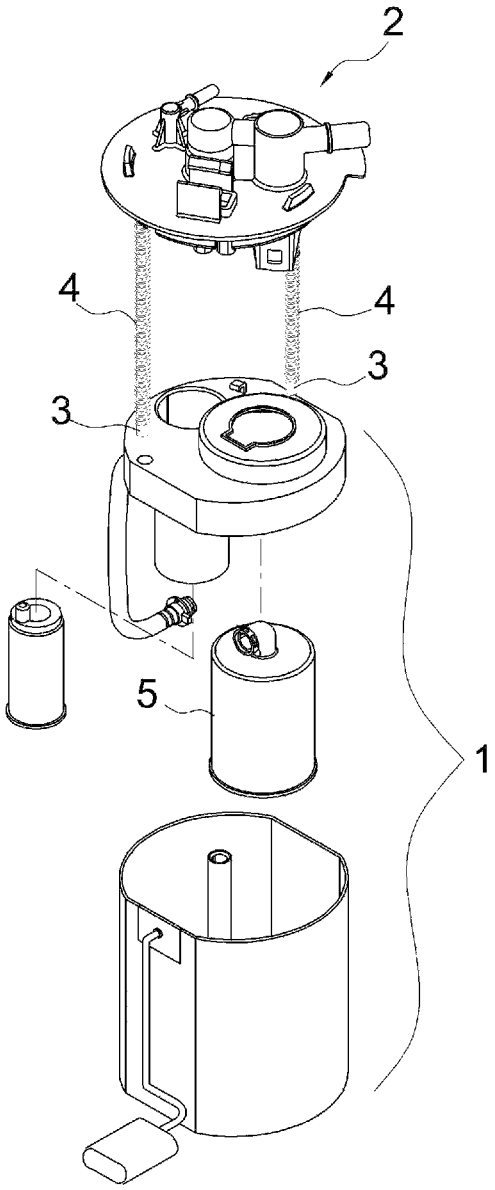
FIG. 1 Prior Art
FIG. 1 is an exploded perspective view of a fuel pump module for describing the fuel pump module according to the related art.
Figure 2:
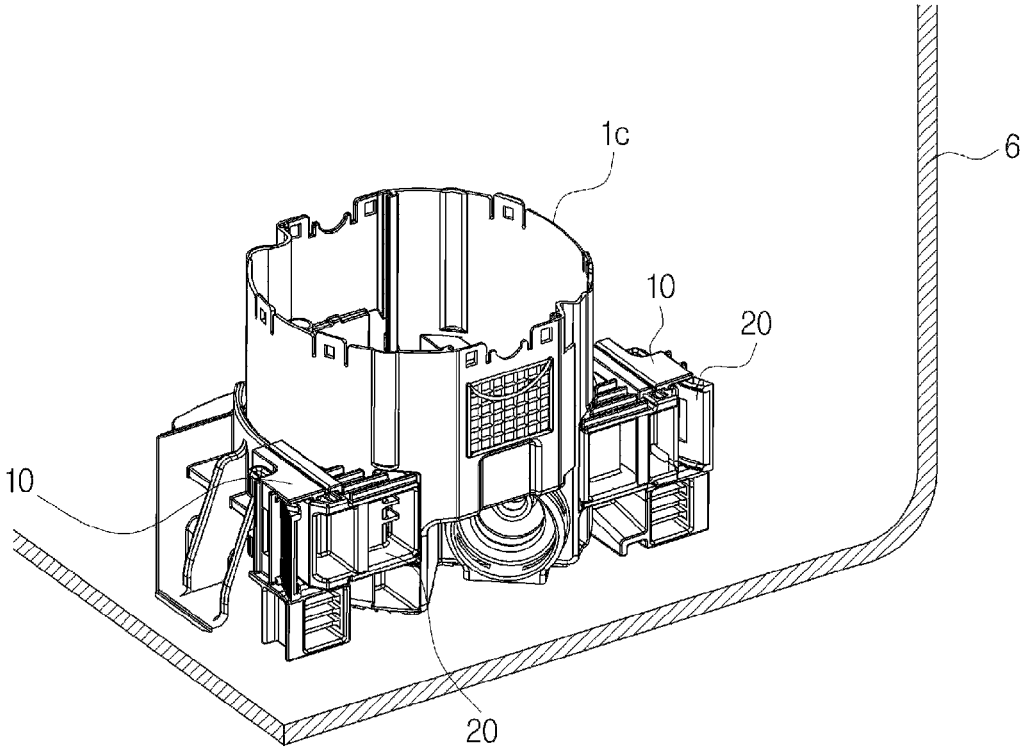
FIG. 2 is a schematic diagram illustrating a state in which an outer case which is a component of a reservoir body assembly is fixed by a fixed retainer and a moving coupled retainer for describing an apparatus for fixing the reservoir body assembly of a fuel pump module into a fuel tank.
Figure 3:
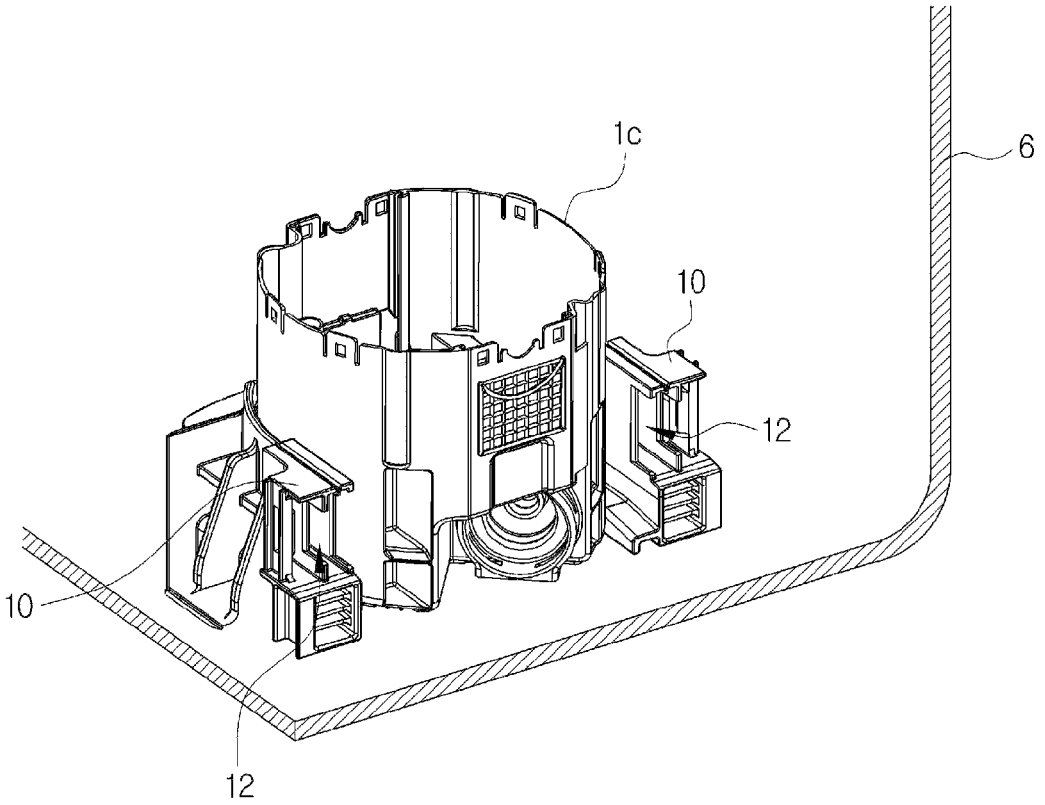
FIG. 3 is a schematic diagram illustrating a state in which the outer case which is the component of the reservoir body assembly is disposed at a location for assembling with the fixed retainer.
Figure 4:
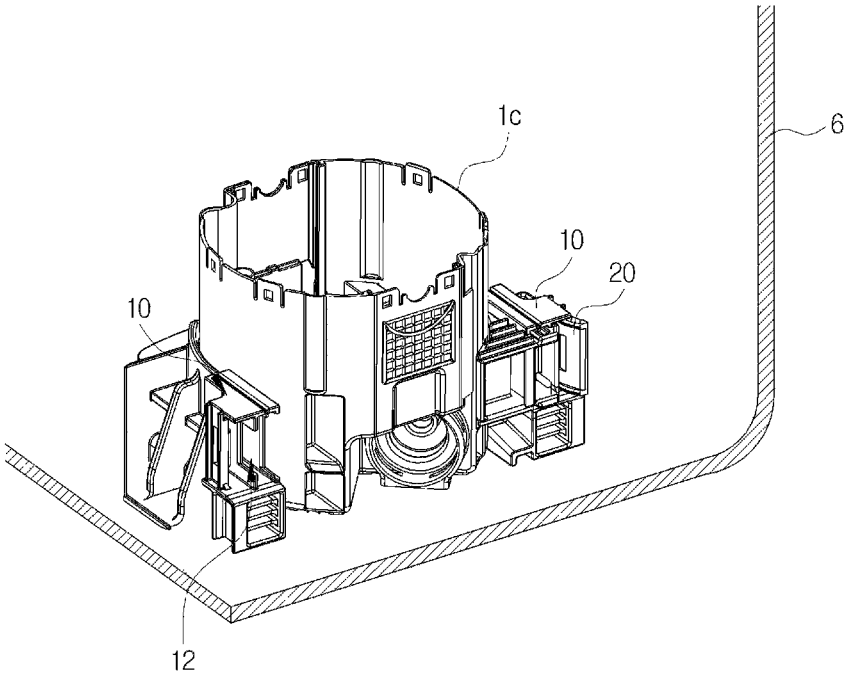
FIG. 4 is a schematic diagram illustrating a state in which a right of the outer case which is the component of the reservoir body assembly in the state of FIG. 3 is coupled with the moving coupled retainer and a left thereof is not coupled with the moving coupled retainer.
Figure 5:
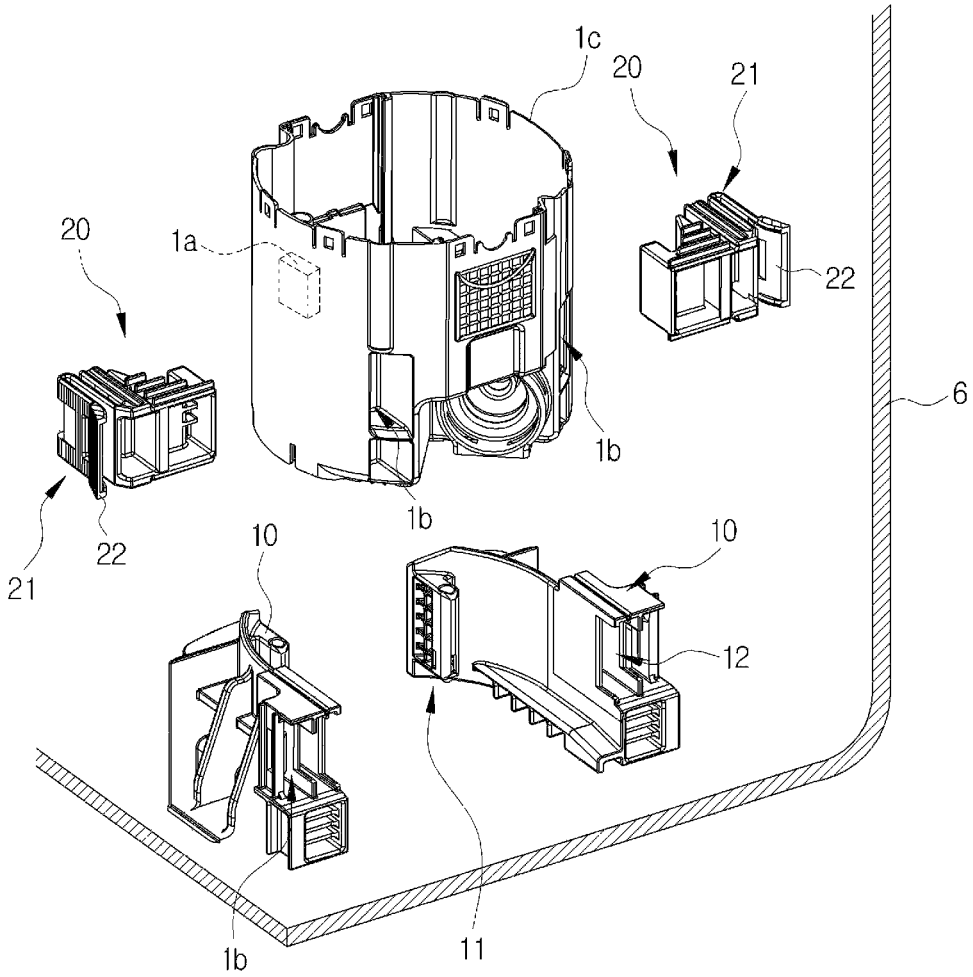
FIG. 5 is an exploded perspective view of FIG. 2.

1: Reservoir body assembly
1*a*: Groove
1*b*: Groove
1*c*: Outer case
2: Flange assembly
3: Guide rod
4: Spring
5: Fuel pump
6: Fuel tank
10: Fixed retainer
11: Coupling guide
12: Groove
20: Moving coupled retainer
21: Hanging protrusion
22: Lever

DETAILED DESCRIPTION OF EMBODIMENTS

Hereinafter, a technical spirit of the present invention will be described in more detail with reference to the accompanying drawings.

However, the accompanying drawings are only examples shown in order to describe the technical idea of the present invention in more detail. Therefore, the technical idea of the present invention is not limited to shapes of the accompanying drawings.

The present invention relates to an apparatus for easily fixing a reservoir body assembly into a fuel tank having a low height to prevent the reservoir body assembly from interfering with a flange assembly.

By the way, an object of the present invention is to provide an apparatus for easily fixing a reservoir body assembly included in a fuel pump module having a structure without a guide rod connecting a reservoir body assembly to a flange assembly into a fuel tank so as to be mounted in a fuel tank having a very low height.

To this end, according to the exemplary embodiment of the present invention, a fixed retainer 10 is disposed in a fuel tank 6 in an integrated state and a moving coupled retainer 20 and a fixed retainer 10 are coupled with each other, having a reservoir body assembly 1 disposed therebetween, in a state in which the reservoir body assembly 1 is disposed at a location at which the fixed retainer 10 is mounted, thereby fixing the reservoir body assembly 1.

That is, the apparatus according to the exemplary embodiment of the present invention has the fixed retainer 10 and the moving coupled retainer 20.

The fixed retainer 10 is fixed in the fuel tank 6 and thus is integrated with the fuel tank 6.

The moving coupled retainer 20 is coupled with the fixed retainer 10 in the state in which the reservoir body assembly 1 pumping fuel in the fuel tank 6 is disposed at the location at which the fixed retainer 10 is mounted, thereby fixing the reservoir body assembly 1.

According to the foregoing structure, the reservoir body assembly 1 is disposed in an inner space of the fuel tank 6 and thus is disposed at an assembling location with the fixed retainer 10 and then the moving coupled retainer 20 which freely moves is fixed by being coupled with the fixed retainer 10, such that the reservoir body assembly 1 may be easily mounted in the fuel tank having a low height.

In the accompanying drawings, the fixed retainer 10 is fixed at a bottom of the inner space of the fuel tank 6.

Fixing the fixed retainer 10 in the inner space of the fuel tank may be implemented by applying various integrated methods such as a reveting method or a welding method.

The coupling method of the fixed retainer 10 and the moving coupled retainer 20 may be implemented in various forms.

Describing a detailed example, a coupling method using a magnetic force, a coupling method using a snap fastener, a coupling method using a hanging groove and a hanging protrusion, and the like may be applied.

However, the coupling method using a magnetic force may give rise to a problem of durability.

Therefore, the method using a hanging groove and a hanging protrusion is preferable.

Describing a detailed example, a hanging protrusion 21 formed in the moving coupled retainer 20 is hanged to the fixed retainer 10 (hanging groove, and the like) to prevent the moving coupled retainer 20 from separating.

In this case, an effect of preventing a separation of the moving coupled retainer 20 or separating the moving coupled retainer 20 by the hanging protrusion 21 is generated by moving a lever 22 included in the moving coupled retainer 20.

The structure may facilitate the separation and coupling of the reservoir body assembly 1.

The reason of separating the moving coupled retainer 20 from the reservoir body assembly 1 is that there is a need to replace and repair the fuel pump module mounted in the vehicle or the reservoir body assembly 1 which is a component of the fuel pump module.

To appropriately cope with the situation, the moving coupled retainer 20 may be separated from the fuel tank 6 and the reservoir body assembly 1 may be separated.

According to the exemplary embodiment of the present invention, when the reservoir body assembly 1 is disposed at the assembling location with the fixed retainer 10 to mount the reservoir body assembly 1, the fixed retainer 10 may be provided with a protrusion type coupling guide 11 inserted into a groove la which is formed in the reservoir body assembly 1.

According to the structure, the reservoir body assembly 1 may be more easily disposed at the mounting location.

That is, the protrusion type coupling guide 11 is inserted into the groove la formed in the reservoir body assembly 1 and thus the reservoir body assembly 1 is disposed at the mounting location, which is a ground of judgment on whether the reservoir body assembly 1 is correctly disposed at the mounting location.

According to the exemplary embodiment of the present invention, the reservoir body assembly 1 may be firmly mounted so as not to move despite a shaking of a vehicle in the state in which the reservoir body assembly 1 is mounted.

To this end, the moving coupled retainer 20 is inserted into a groove lb formed in the reservoir body assembly to prevent the moving coupled retainer 20 from moving left and right and upward.

The structure may be simple, facilitate the separation and coupling, and obtain the excellent action effect.

According to the exemplary embodiment of the present invention, the fixed retainer 10 may have a shape corresponding to an appearance of the coupling portion with the reservoir body assembly 1, for example, a curved surface corresponding to an appearance of an outer case 1*c* which is a component of the reservoir body assembly 1 as illustrated in the accompanying drawings.

According to the exemplary embodiments of the present invention, the fixed retainer is disposed in the fuel tank in the integrated state and the moving coupled retainer and the fixed retainer are coupled with each other, having the reservoir body assembly disposed therebetween, in the state in which the reservoir body assembly is disposed at the location at which the fixed retainer is mounted, thereby easily fixing the reservoir body assembly into the fuel tank having the low height.

Further, the moving coupled retainer may be separated in the state in which the moving coupled retainer is coupled with the fixed retainer, and thus the reservoir body assembly may be easily repaired.

Further, the hanging protrusion formed in the moving coupled retainer is hanged to the fixed retainer to prevent the moving coupled retainer from separating and the structure in which the effect of preventing the moving coupled retainer from separating or separating the moving coupled retainer by the hanging protrusion is generated by moving the lever included in the moving coupled retainer may facilitate the separation and coupling of the reservoir body assembly.

The accompanying drawings illustrate a structure of a left and right pair of fixed retainers and a left and right pair of moving coupled retainer.

What is claimed is:

1. An apparatus for fixing a component of a fuel pump module into a fuel tank, comprising:

a fixed retainer fixed into a fuel tank to be integrated with the fuel tank; and a moving coupled retainer coupled with the fixed retainer and a reservoir body assembly in a state in which the reservoir body assembly pumping fuel in the fuel tank is disposed at an assembling location with the fixed retainer to mount the reservoir body assembly so as to fix the reservoir body assembly, wherein the moving coupled retainer is separated in a state in which the moving coupled retainer is coupled with the fixed retainer and the reservoir body assembly, a hanging protrusion formed in the moving coupled retainer is hanged to a groove formed in the fixed retainer to prevent the moving coupled retainer from separating, and a protrusion formed in the moving coupled retainer is inserted into a groove formed in an inner direction of the reservoir body assembly to prevent the moving coupled retainer from moving left and right, and upward.

2. The apparatus of claim 1, wherein a lever is formed in the moving coupled retainer and an effect of preventing a separation of the moving coupled retainer or separating the moving coupled retainer by the hanging protrusion is generated by moving the lever.

3. The apparatus of claim 1, wherein when the reservoir body assembly is disposed at the assembling location with the fixed retainer to mount the reservoir body assembly, the fixed retainer is provided with a protrusion type coupling guide inserted into the groove which is formed in the inner direction of the reservoir body assembly.

* * * * *